US007445518B2

(12) United States Patent
Schneider neé Hild et al.

(10) Patent No.: US 7,445,518 B2
(45) Date of Patent: Nov. 4, 2008

(54) PRESSURE CONTACT

(76) Inventors: Anja Schneider neé Hild, Bergstr. 46, D-58256 Ennepetal (DE); Henning Taschke, Varenholzstr. 102, D-44869 Bochum (DE)

( * ) Notice: Subject to any disclaimer, the term of this patent is extended or adjusted under 35 U.S.C. 154(b) by 0 days.

(21) Appl. No.: 11/800,415

(22) Filed: May 4, 2007

(65) Prior Publication Data

US 2007/0270009 A1 Nov. 22, 2007

(30) Foreign Application Priority Data

May 5, 2006 (DE) ..... 10 2006 020 955

(51) Int. Cl.
*H01R 13/28* (2006.01)

(52) U.S. Cl. ..... 439/700

(58) Field of Classification Search ..... 439/700, 439/289, 88, 824, 826, 862; 257/507
See application file for complete search history.

(56) References Cited

U.S. PATENT DOCUMENTS 4,451,818 A * 5/1984 Grabbe et al. ..... 439/296
4,906,194 A * 3/1990 Grabbe ..... 439/71
5,167,512 A * 12/1992 Walkup ..... 439/66
5,199,889 A * 4/1993 McDevitt, Jr. ..... 439/66
5,427,535 A * 6/1995 Sinclair ..... 439/66
5,513,435 A * 5/1996 Benjamin ..... 30/264
5,573,435 A * 11/1996 Grabbe et al. ..... 439/862
5,820,389 A * 10/1998 Hashiguchi ..... 439/66
5,966,267 A 10/1999 Hooley
6,200,151 B1 3/2001 Kameko
6,290,524 B1 * 9/2001 Simmel ..... 439/289
6,315,576 B1 * 11/2001 Neidich ..... 439/66
6,379,187 B2 4/2002 Nishimatsu
6,504,223 B1 1/2003 Zhou
6,504,595 B2 * 1/2003 Nicolaisen et al. ..... 349/149
6,783,405 B1 8/2004 Yen
7,112,103 B2 * 9/2006 Zhang et al. ..... 439/700

FOREIGN PATENT DOCUMENTS

DE 82 982 8/1971
WO 96/28865 9/1996
WO 2005/122339 12/2005

* cited by examiner

*Primary Examiner*—Alexander Gilman
(74) *Attorney, Agent, or Firm*—Andrew Wilford

(57) ABSTRACT

A pressure contact for making an electrical connection with another contact has two end parts spaced apart along a longitudinal axis, a central spring section having a midpoint lying on the longitudinal axis, a plurality of side spring sections at least one of which extends at an acute angle to the longitudinal axis, and a plurality of loops between and connecting the spring sections. The central and side spring sections together with the loops form a meander spring so that displacement of one of the end parts longitudinally toward the other end part tensions the meander spring.

18 Claims, 9 Drawing Sheets

PRESSURE CONTACT

FIELD OF THE INVENTION

The present invention relates to a pressure contact. More particularly this invention concerns such a contact intended to establish an electrical connection with another contact by simply pressing against the other contact.

BACKGROUND OF THE INVENTION

A pressure contact for connection with at least one other contact has two end parts spaced apart along a longitudinal axis extending from one part to the other part, and a meander spring having spring sections, each of which connects two meander loops. The parts are separated from one another by means of the meander spring which can elastically deform to absorb pressure force exerted by at least one other contact on at least one of the end parts to allow inward movement, yielding to the pressure force, of the one part along the longitudinal axis.

Pressure contacts having meander springs, which are usually a component of a plug-in connector, are known from U.S. Pat. No. 6,783,405 B1 and WO 1996/028865, for example. The contact together with its meander spring is provided either in the plug or in the socket of the plug-in connector, and in conjunction with a suitable other contact forms a pressure-fit electrical connector. The housings of the plug and socket fit complementarily together and can lock to maintain the plug-in connection.

Common application examples of pressure contacts, as disclosed in WO 1996/028865, for example, in particular are interfaces for mobile communication devices such as mobile telephones. By use of the pressure contacts it is possible to transmit various data signals and/or to charge the internal battery of a cell telephone.

The increasing miniaturization of mobile communication devices having an increasingly larger number of functions also requires a reduction in size of the above-described interfaces without impairing the reliability of the interface connections, in particular the electrical connection between the pressure contact and the other contact. The quality of the connection between the pressure contact and other contact is influenced essentially by the elastic tension of the meander spring for the pressure contact and an exact positioning of the engaging parts of the pressure contact and other contact with respect to one another. Besides the selection of suitable material for the meander spring (for example, soft or hard spring steel), for transversely tensioned meander springs known from the prior art the pressure force is specified by the number of meander loops and thus ultimately by the spatial extension of the meandering spring. In the sense of the present patent application, a tensioned meander spring is a spring whose spring section connecting two meander loops is oriented essentially transverse to the pressure force, i.e. transverse to the longitudinal axis.

A pressure contact is known from U.S. Pat. No. 6,200,151 that by means of a specially designed C-spring is intended to compensate for motion of the part outside the motion path lying on the longitudinal axis. However, in this approach as well the C-spring is pretensioned in the region of the part by means of the housing, and the part is also ultimately guided in this manner. Thus there is some lateral shifting and a need to provide a guide for the pressure contact to keep it aligned.

A solid connection of the parts of the pressure contact and other contact requires a certain minimum size of the contact areas of the parts, in particular of the other contact, since the end part for the pressure contact is laterally tilted when a meander spring is used. Although this area may be reduced in size, a guide for the part is then necessary on the sides of the housing for the pressure contact in order to reliably prevent lateral tipping.

It is apparent that the known pressure contacts, due to their space requirement for the meander spring and the mutual contact areas of the pressure contact and other contact, or for a guide usually formed by the housing of the plug-in connector, no longer meet the demands for increasing miniaturization of such modules.

OBJECTS OF THE INVENTION

It is therefore an object of the present invention to provide an improved pressure contact.

Another object is the provision of such an improved pressure contact that overcomes the above-given disadvantages, in particular that requires less space while maintaining a secure electrical connection with another contact.

A further object in particular is to produce a pressure contact that also provides a self-guiding part under high elastic forces.

SUMMARY OF THE INVENTION

A pressure contact for making an electrical connection with another contact has according to the invention two end parts spaced apart along a longitudinal axis, a central spring section having a midpoint lying on the longitudinal axis, a plurality of side spring sections at least one of which extends at an acute angle to the longitudinal axis, and a plurality of loops between and connecting the spring sections. The central and side spring sections together with the loops form a meander spring so that displacement of one of the end parts longitudinally toward the other end part tensions the meander spring.

Such a meander spring is much smaller than known meander springs having the same spring constant. In addition, the elastic tensions in the meander spring occurring on both sides of the longitudinal axis act in opposite directions, thereby stabilizing the meander spring itself. For secure motion on the longitudinal axis, therefore, the part does not require a separate guide. Due to this self-guiding action, the contact area for the other contact may be reduced to the size necessary for a secure connection, since tipping and lateral shifting on the other contact is reliably prevented.

One embodiment provides that the side spring sections are designed to be essentially parallel to the longitudinal axis, particularly when the central spring section connecting two meander loops defines an acute angle, that is an angle of less than 90°, with respect to the longitudinal axis. This embodiment ensures an extremely secure self-guiding of the pressure contact.

In one preferred embodiment of the invention, an identical number of side spring sections is provided on both sides of the longitudinal axis, the meander spring being point-symmetrical with respect to the midpoint of the central spring section, as the result of which the elastic forces occurring in the meander spring on both sides of the longitudinal axis are identical in magnitude but oppositely directed.

According to a further preferred embodiment, the meander spring is designed such that the central spring section of the meander spring is essentially tension-free when elastic tension develops, in particular when the meander spring rotates about the point of symmetry when elastic tension develops. Such a design results in a spiral-shaped contraction or compression of the meander spring of the pressure contact according to the invention, thereby further reducing the space requirements for the meander spring in the tensioned state.

The orientation of the central spring section of the meander spring relative to the longitudinal axis is one of the key factors influencing the elastic tension of the meander spring, and thus the pressure force on the part. According to preferred embodiments, the central spring section therefore intersects the longitudinal axis at an angle of less than 60°, or less than 45°, or less than 30°. However, depending on the pressure force to be achieved, any other acute angles, i.e. angles less than 90°, with respect to the longitudinal axis are possible.

In one preferred embodiment, the side spring sections have a curved or C-shape. Thus, in the present patent application curved side spring sections are oriented essentially parallel to the longitudinal axis, provided that the longitudinal axis of the curved side spring sections is aligned essentially in parallel with the longitudinal axis. Such side spring sections allow the design of the pressure contact to be further reduced in size.

The self-guiding action of the part, i.e. the movement of the part solely along the longitudinal axis, is further improved when at least one end part has two contact feet provided at a spacing from each other, in particular when the contact feet are symmetrical to the longitudinal axis.

The parts and the meander spring preferably are integrally formed from a single material, particularly preferably as leaf springs. In fact the entire meander spring can be of uniform cross sectional size, except at the midpoint in some embodiments.

The contact according to the invention may be designed as a board-to-board connector by the fact that both parts form a pressure connection with a respective associated other contact. In the standard embodiment, a board-to-board contact connects printed conductors or contact fields of two printed circuit boards solely by pressure, which does not exclude this pressure connection from being secured by a form-fit connection or other types of connections of, for example, a contact housing.

For a pressure contact, in particular a pressure contact that connects two printed circuit boards in a pressure-fit manner, it is advantageous for the pressure contact in the region of its midpoint to have a support by means of which the meander spring is pivotally supported in a housing. This allows the contact to be fixed to the housing without hindering the above-referenced rotation of the meander spring.

In its simplest form, the pressure contact is characterized by the fact that exactly one central meander spring is present that connects two meander loops.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 17:
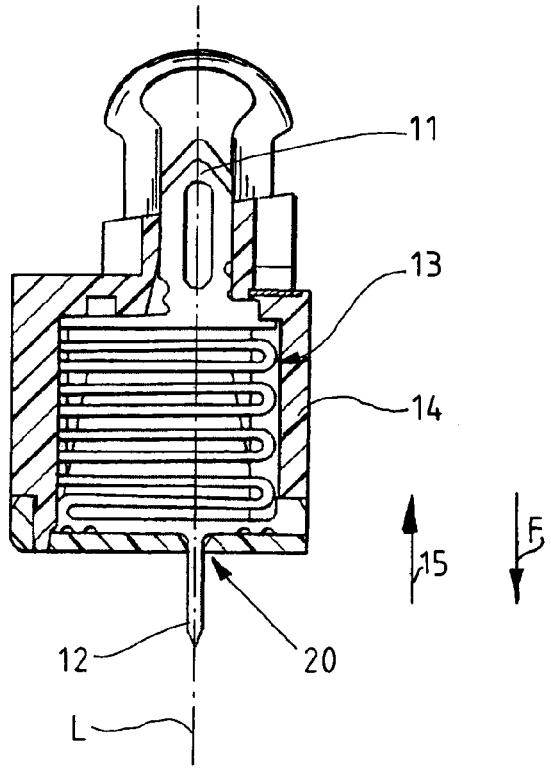
Fig. 17 PRIOR ART
FIGS. 16 and 17 shows the prior art according to WO 1996/028865.
Figure 16:
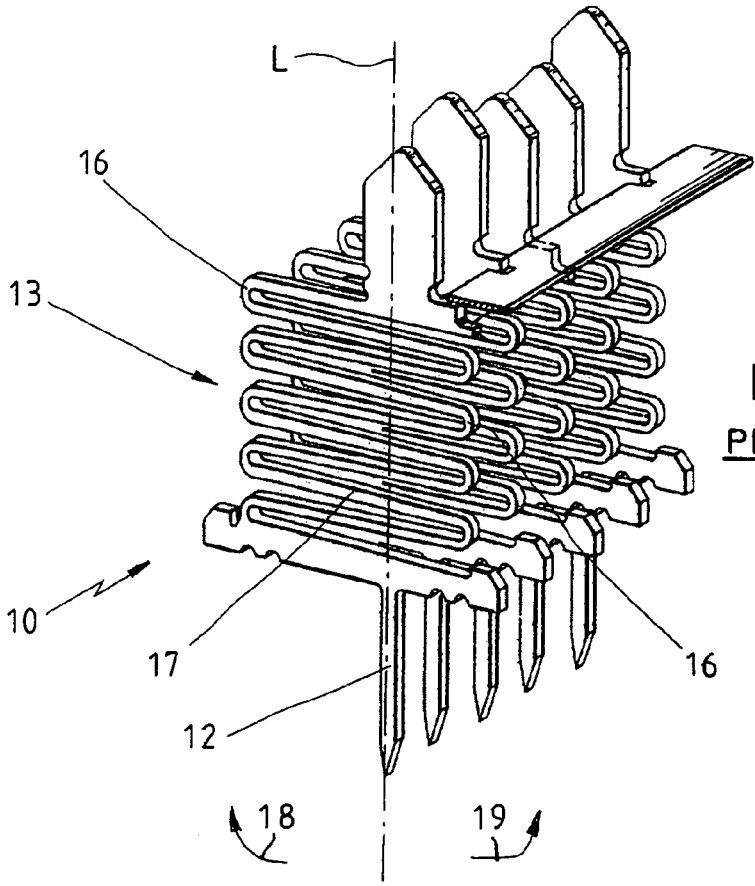
Fig. 16 PRIOR ART

FIGS. 16 and 17 show the prior art according to WO 1996/028865, the reference numerals being changed with respect to those of respective FIGS. 25*c* and 25*d* of the cited document. Here a pressure contact 10 comprises a first part 11 and a second part 12. Parts 11 and 12 are separated by a meander spring 13. A longitudinal axis L extends from the first part 11 to the second part 12. In FIG. 17 the pressure contact 10 is supported in a housing 14, and the second part 12 projects from the housing 14 in order to make a pressure connection with an other not shown contact, e.g. a trace of a circuit board or a simple flat contact surface.

To establish a pressure connection, the other contact (not shown) is pressed in the direction of arrow 15 against the part 12, which moves in the direction of arrow 15 into the housing 14. The meander spring 13 is compressed in an accordion-like manner, and presses in direction F against the other contact, ensuring the pressure connection between the part 12 and the other contact.

The meander spring 13 has multiple meander loops 16 that are connected by means of multiple side spring sections 17. In the prior art, the spring sections extend essentially transverse to the longitudinal axis L, i.e. transverse to the direction 15, which represents a direction of motion of the part 12 that yields to the other contact. Thus such a meander spring 13 represents a transversely tensioned meander spring 13 that causes the part 12 to yield in an unstable manner in the direction of the arrow. The part 12 tends to tilt to one side or the other as shown by arrows 18 and 19. To nevertheless ensure a secure position on the other contact, either a large-surface contact or a suitable guide for the part 12, such as, for example, a suitable housing opening 20 shown in FIG. 17 is required. In addition, a meander spring 13 shown in FIGS. 16 and 17 is a comparatively soft spring with low spring constants, so that a large number of meandering windings 16 or a large spring excursion is necessary to ensure a certain pressure force.

As described at the outset, the referenced design features of the known contact 10 having a comparatively low pressure force exerted by the meander spring 13 on the other contact and at the same time having a comparatively low space requirement conflicts with the increasing demands for miniaturization of pressure connectors. Therefore, the invention provides an improved pressure contact 10 as described below.

Figure 2:
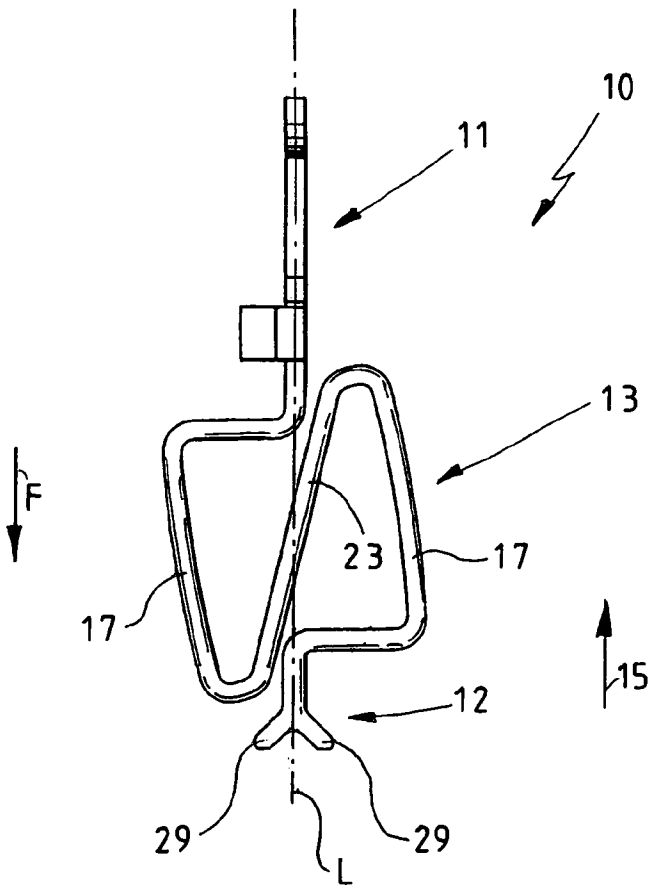
FIG. 2 shows the pressure contact according to FIG. 1, with its meander spring under tension.
Figure 1:
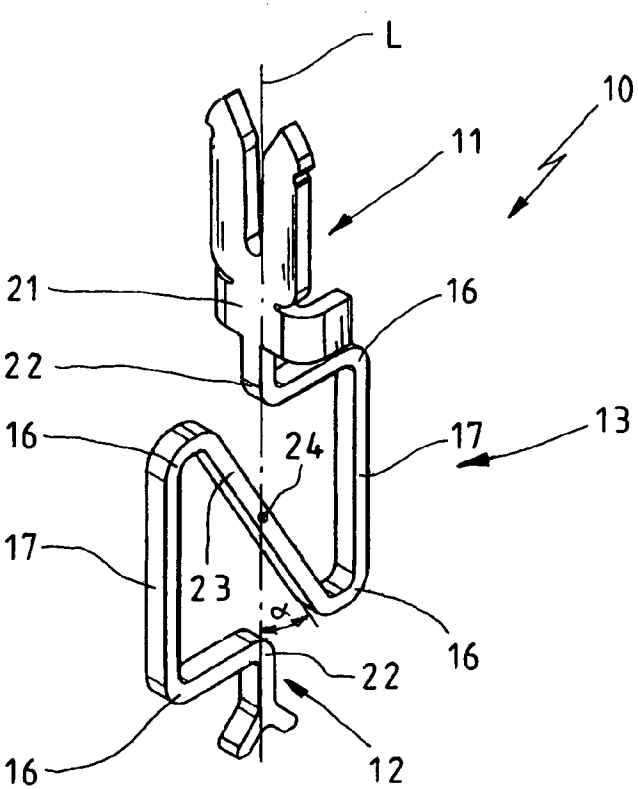
FIG. 1 is a pressure contact according to the invention, in a simple design in a perspective view.

FIGS. 1 and 2 illustrate a pressure contact 10 according to the invention that also has a first normally stationary part 11 and a second normally movable part 12 longitudinally flank a meander spring 13. In this embodiment, the first part 11 is designed as a blade contact for connection to an electrical conductor such as a wire, for example, and also has a clamping section 21 by means of which the pressure contact 10 may be fixed to the housing (not shown) for a pressure connector. Both parts 11 and 12 are spaced apart along a longitudinal axis L extending from one part 11 to the other part 12.

The meander spring 13 has four meander loops 16 and two bends 22 that connect the parts 11 and 12. The meander loops 16 are connected to one another by means of side spring sections 17 and a central spring section 23. Thus, the central spring section 23 may also be referred to as a connecting section 23. The central spring section has a geometric midpoint 24 that lies on the longitudinal axis L. In the present example the spring section 23 defines an angle $\alpha$ of approximately 45° with respect to the longitudinal axis L and crosses it. The side spring sections 17 flanking the longitudinal axis L are parallel to the longitudinal axis L.

FIG. 2 shows the pressure contact according to FIG. 1 with the meander spring 13 under tension, that is with the parts 11 and 12 moved longitudinally toward each other with elastic deformation of the element 13. The pressure contact 10 assumes this inner position when another contact (not shown here) makes a pressure connection with the part 12, and as previously described with regard to the prior art (FIGS. 16 and 17) the part 12 moves longitudinally in the direction 15. Also in the present example, the meander spring 13 exerts a force F in the opposite direction on the part 12 and thus on the other contact. Since the side spring sections 17 in contrast to the prior art are oriented parallel to the longitudinal axis L and thus in the direction of motion 15, i.e. the direction of force F, in the present invention the meander spring 13 is referred to as a longitudinally tensioned meander spring 13. The pressure force F extends essentially along the contact side spring sections 17.

Figure 12:
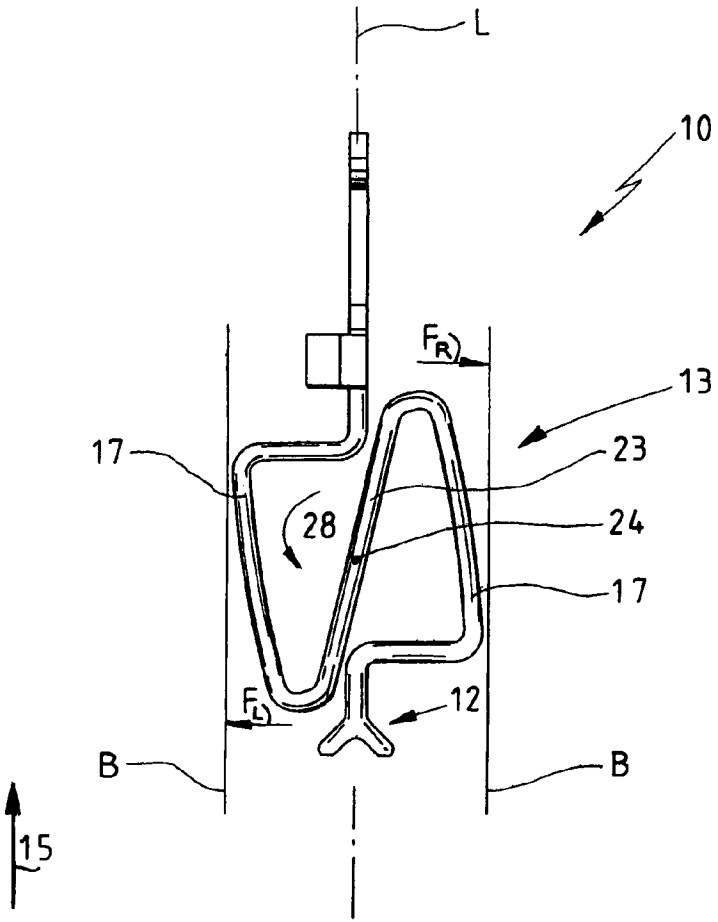
FIGS. 11 and 12 show a pressure contact according to FIGS. 1 and 2, respectively, for the schematic illustration of the acting elastic forces.
Figure 11:
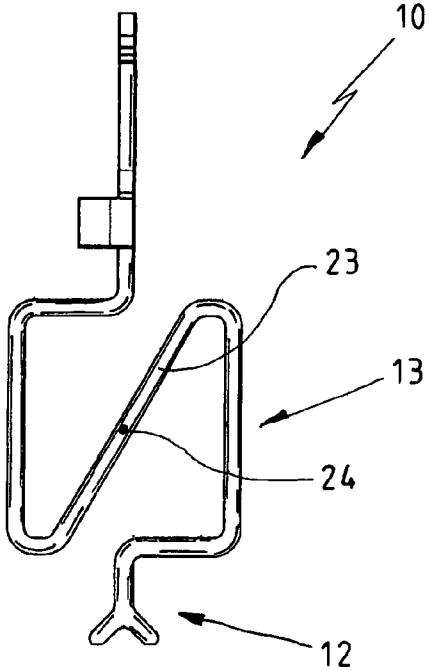

FIG. 11 shows the meander spring 13 of FIGS. 1 and 2 in a tension-free rest or outer position, and in FIG. 12 the meander spring 13 is under tension. The lines B in FIG. 12 represent the width of the meander spring 13 in the untensioned state according to FIG. 11. In this case, the width is the spatial extension of the meander spring 13 measured transverse to the longitudinal axis L.

The effect of the point-symmetrical design of the meander spring 13 in the development of spring tension is shown very well by the comparative illustrations in FIGS. 11 and 12. The motion of the part 12 in the direction 15, initiated by establishing a pressure connection with another contact not shown here, results in a curvature and thus results in the formation of elastic tension, in particular for the side spring sections 17.

An elastic force $F_L$, directed to the left with respect to the plane of the drawing and the longitudinal axis L, occurs that acts on the right spring section 17, and an elastic force $F_R$, directed to the right, occurs that acts on the left spring section 17. The elastic forces $F_R$ and $F_L$ have identical magnitudes but opposite directions.

The elastic forces $F_L$ and $F_R$ represent all the elastic forces occurring in the meander spring 13, each elastic force that occurs on one side of the longitudinal axis L being associated with an elastic force that occurs on the other side of the longitudinal axis and having an identical magnitude but opposite direction. The meander spring 13 is therefore automatically stabilized. At the same time, the central spring section 23 tilts about its midpoint 24 in the direction 28 when elastic tension develops, so that the meander spring 13 forces linear motion of the part 12 along the longitudinal axis L. Guiding of the part 12, which is required in the prior art, is therefore unnecessary in the pressure contact 10 according to the invention on account of this self-stabilizing design of the meander spring 13.

It is therefore essential to the invention that the meander spring 13 be designed so that the side spring sections 17 are positioned with respect to one another such that the meander spring 13 rotates about its midpoint 24 when elastic tension develops. The meander spring 13, i.e. the midpoint 24, may be displaced relative to, for example, a housing in which the pressure contact 10 is supported. The meander spring 13 preferably contracts as a result of the rotational motion.

Figure 4:
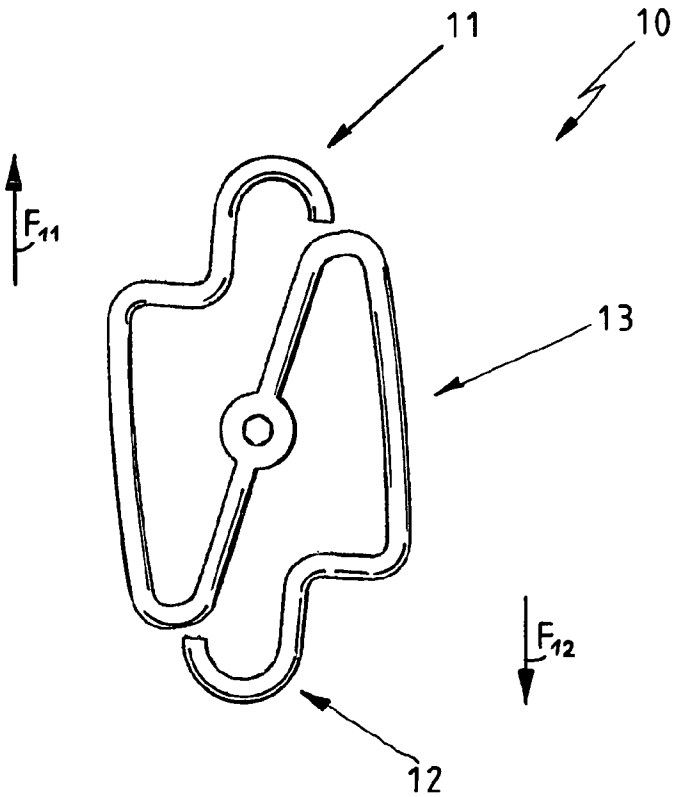
FIG. 4 shows the board-to-board connector according to FIG. 3 under elastic tension.
Figure 3:
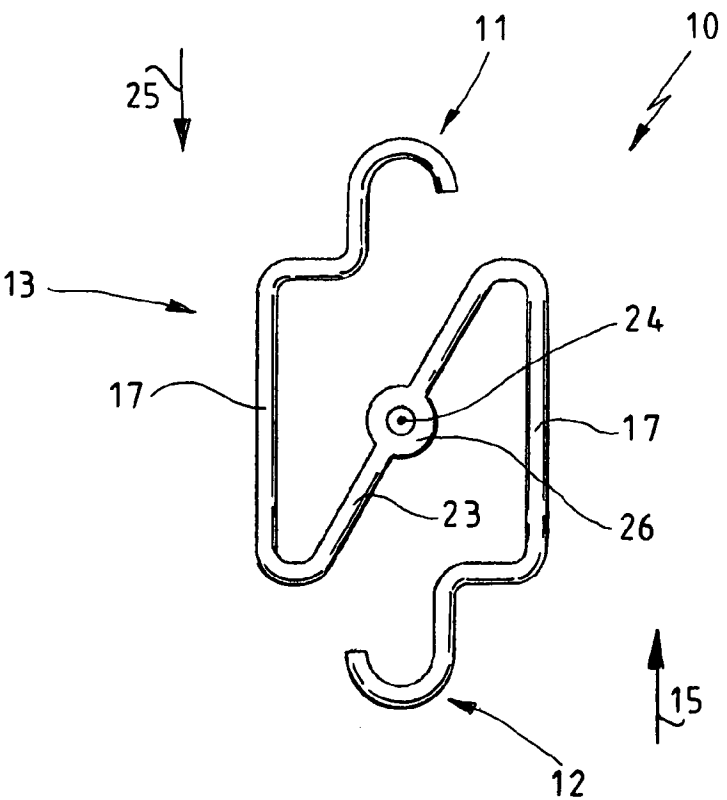
FIG. 3 shows the pressure contact according to FIG. 1, designed as a board-to-board contact.

FIGS. 3 and 4 show a further embodiment of the pressure contact 10 according to the invention. This involves a board-to-board contact in which both parts 11 and 12 are designed for a pressure connection with a respective other contact (not shown). Here, as described above, the part 12 yields to the associated other contact (not shown) in the direction of motion 15 when a pressure connection is established. The same principle applies in the design of the part 11 for a pressure connection with an associated other contact (not shown). However, the part 11 undergoes an opposite motion in the direction 25. As a result, as shown in FIG. 4, the meander spring 13 for the pressure contact 10 is subjected to tension as previously described. In this case, however, the meander spring exerts not only the pressure force $F_{12}$ on the other contact associated with the contact spring section 12, but also exerts an opposite pressure force $F_{11}$ on the other contact associated with the contact spring section 11.

FIGS. 3 and 4 also show a support 26 in the region of the midpoint 24 of the central spring section 23. This support 26 is designed in such a way that, although the pressure contact 10 is fixed to the housing, the pressure contact may be mounted so as to be pivotable about the physical midpoint 24 in a housing (not shown).

Figure 6:
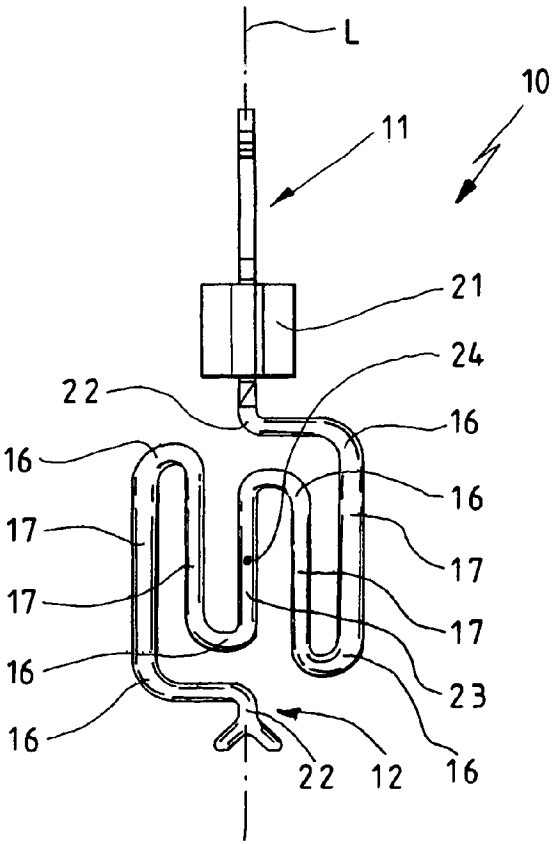
FIG. 6 shows the pressure contact according to FIG. 5 in a front view.
Figure 5:
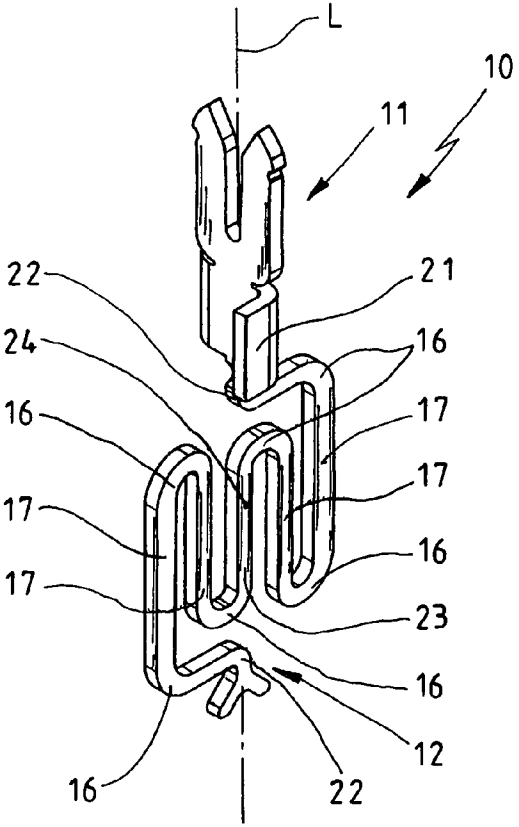
FIG. 5 shows a pressure contact having a meander spring with multiple meander loops, in a perspective view.
Figure 7:
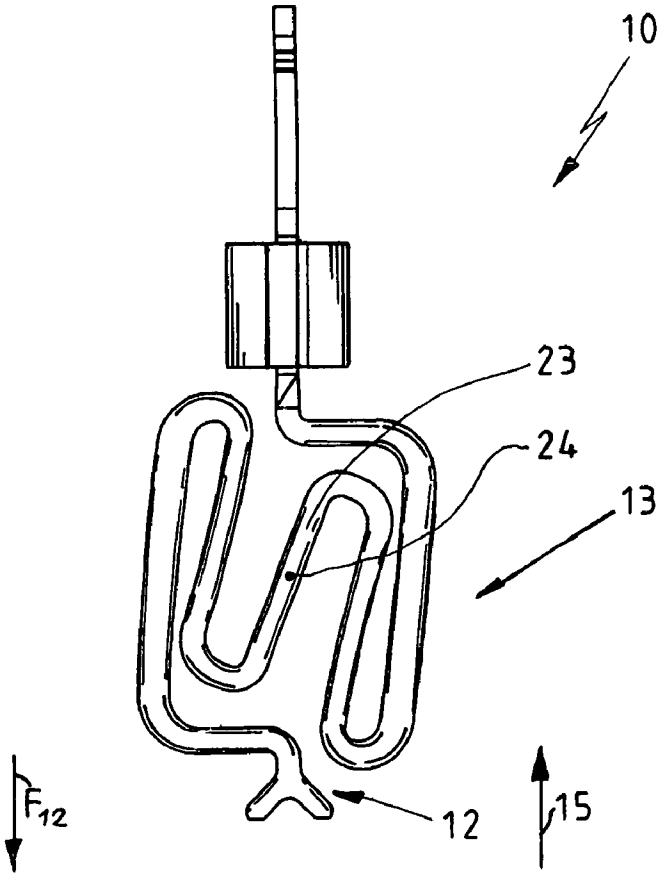
FIG. 7 is a view like FIG. 6, but with the meander spring under tension.

FIGS. 5 through 7 illustrate a pressure contact 10 whose meander spring 13 has been expanded by additional meander loops 16 compared to the basic design shown in FIGS. 1 and 2. FIG. 7 shows the inner position of the pressure contact 10 when the meander spring 13 is under tension. For identical tensions, such a meander spring 13 allows a greater spring excursion, i.e. has a relatively soft resiliency.

In contrast to the meander spring 13 shown in FIGS. 1, 2, 11, and 12, the meander spring 13 in FIGS. 5 through 7 has six meander loops 16 that are connected to one another by means of multiple side spring sections 17 and a central spring section 23. The central spring section 23 lies substantially on the longitudinal axis L. The angle between the central spring section 23 and the longitudinal axis L is therefore 0°. Here as well, the central spring section 23 has a midpoint 24 that lies on the longitudinal axis L.

An important principle of the preferred embodiments is revealed in an comparison of FIG. 1 and FIGS. 5 and 6. Attention is directed to the central spring section 23, which defines an acute angle of less than 90° with respect to the longitudinal axis L. Depending on the design of the meander spring 13, any angle between 0° and 90° between the central spring section 23 and the longitudinal axis L is therefore considered to be in the untensioned elastic state. Any angle $\alpha$ between a spring section 17, 23 and the longitudinal axis that is less than 90° is an acute angle in the sense of the invention.

Figure 8:
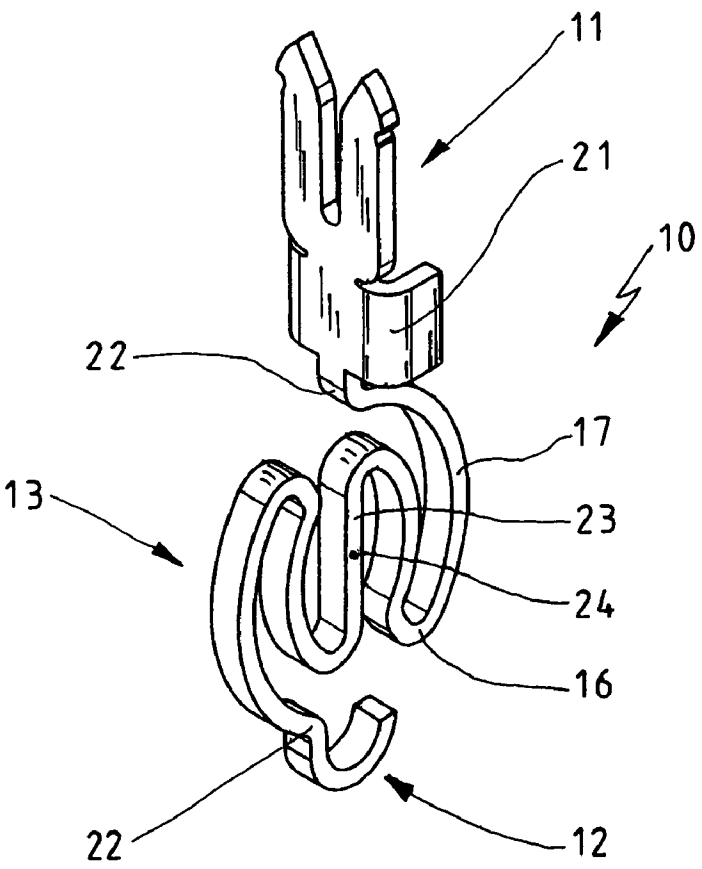
FIG. 8 shows a pressure contact according to the invention with a meander spring with multiple meander loops and curved side spring sections, in a perspective view.
Figure 10:
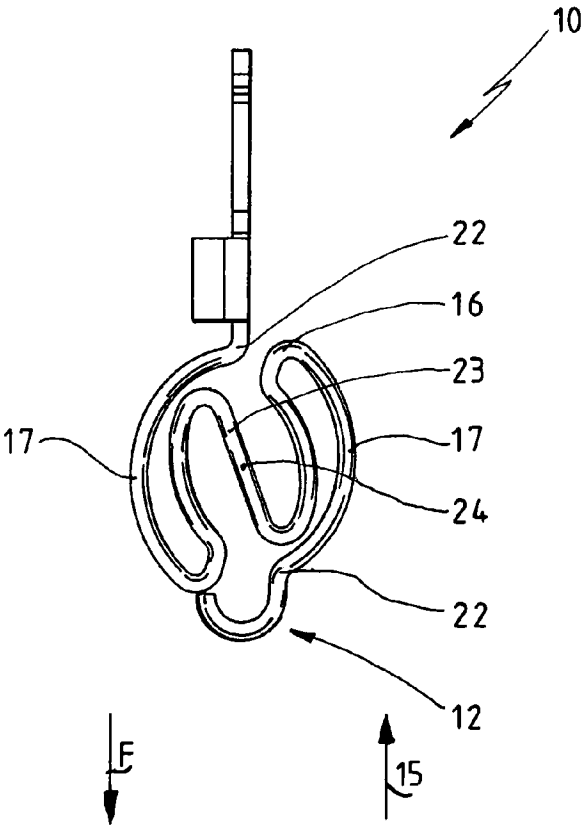
FIG. 10 is a frontal view according to FIG. 9, with the meander spring under tension.
Figure 9:
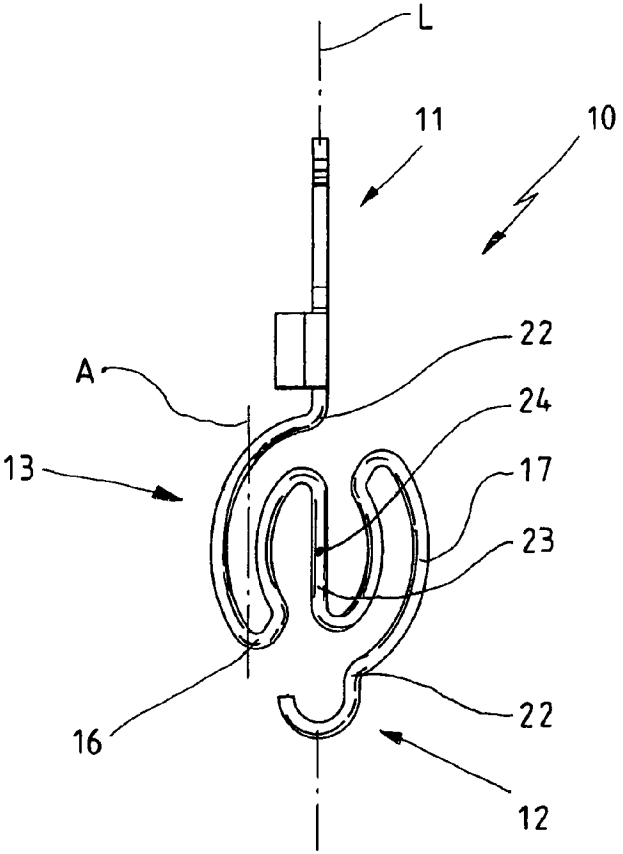
FIG. 9 is a front view according to FIG. 8.

The shown embodiment according to FIGS. 8 through 10 represents a modification of the pressure contact 10 in FIGS. 5 through 7. In this shown embodiment, the meander spring 13 comprises four meander loops 16 that are connected to one another by means of side spring sections 17 and a central spring section 23. The same as for the shown embodiment according to FIGS. 5 through 7, the central spring section 23 lies on the longitudinal axis L, and has a midpoint 24 that lies on the longitudinal axis L and defines an angle of 0° with respect to the longitudinal axis L. However, the side spring sections 17 have a curved design in the manner of C-springs. Thus, a meander spring 13 may be described that comprises multiple symmetrically connected C-springs or C-shaped side spring sections 17.

Further principles of the inventive concept are revealed in a comparative examination of the shown embodiments previously discussed. First, the meander spring 13 basically has a point-symmetrical design with respect to the midpoint 24 of the central spring section. In addition, the side spring sections 17 are preferably oriented parallel to the longitudinal axis L. However, it is sufficient if the side spring sections 17 define an acute angle $\alpha$, i.e. an angle of less than 90°, with respect to the longitudinal axis L. In the illustrations in FIGS. 1 through 7 the side spring sections 17 are oriented strictly parallel to the longitudinal axis L in the untensioned state of the meander spring 13, and in the tensioned state they have a curvature and a slightly angular orientation relative to the longitudinal axis L.

The illustrations in FIGS. 8 through 10 clearly show an orientation of the curved side spring sections 17 parallel to the longitudinal axis L. This design of the spring sections, whose longitudinal axis A extends essentially parallel to the longitudinal axis L, is therefore also considered to be an essentially parallel orientation.

Figure 13:
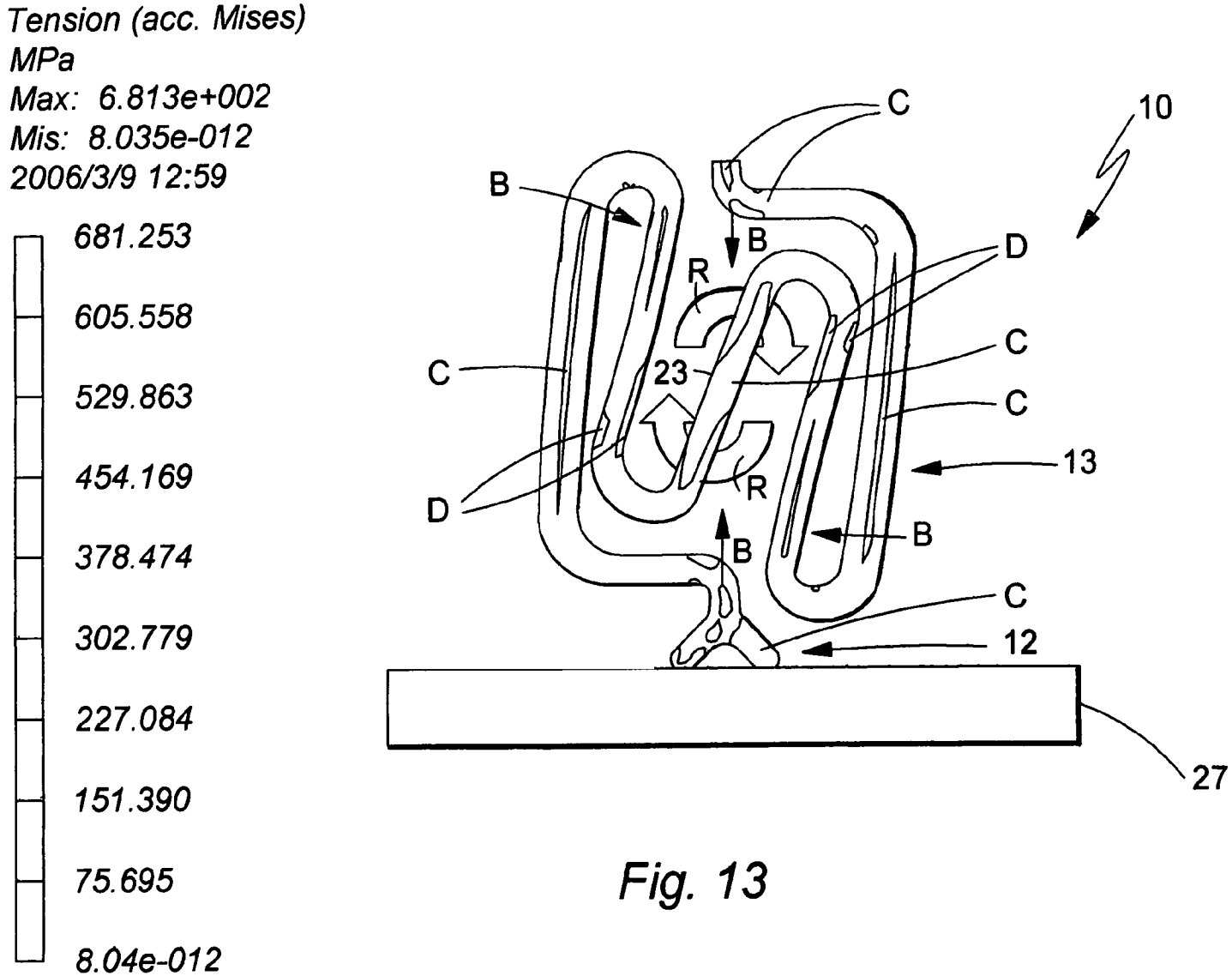
FIG. 13 shows the stress relationships occurring in the meander spring of the pressure contact according to FIG. 7.

FIG. 13 shows a comparative tension measurement of the pressure contact 10 shown in FIGS. 5 through 7, which, however, may be applied to the other embodiments.

The dark regions of the meander spring 13 identified by reference numeral C represent virtually tension-free regions, the tension becoming greater in the increasingly lighter regions. The dark regions identified by reference numeral D, in turn, are locations with the highest elastic tension. This illustration also clearly shows that the tension relationships for the midpoint of the central spring section 23 (not shown here) are likewise mirror-symmetrical. The central meander spring 23 itself is substantially tension-free, and therefore has a negligible elastic effect. The central meander spring is used solely to connect the side spring sections 17. Also shown is the rotational motion, represented by the arrows R, of the meander spring 13 about the midpoint 24 of the central spring section 23.

In FIGS. 1, 2, 5 through 7, 11 through 13, and 14 and 15, the part 12 provided for establishing a pressure connection with another contact (not shown) has a special design. The part 12 forms two contact feet 29, identified only in FIG. 2, in a mirror-symmetrical manner with respect to the longitudinal axis. The part 12 thus forms a V-shaped contour that is open toward the other contact (not shown). In contrast to the parts 11 and 12 from the prior art that are designed for a point or line contact according to FIGS. 16 and 17 and in FIGS. 3 and 4, on account of its vertical extension the part 12 as previously described further prevents the risk of rolling or tipping.

Figure 14:
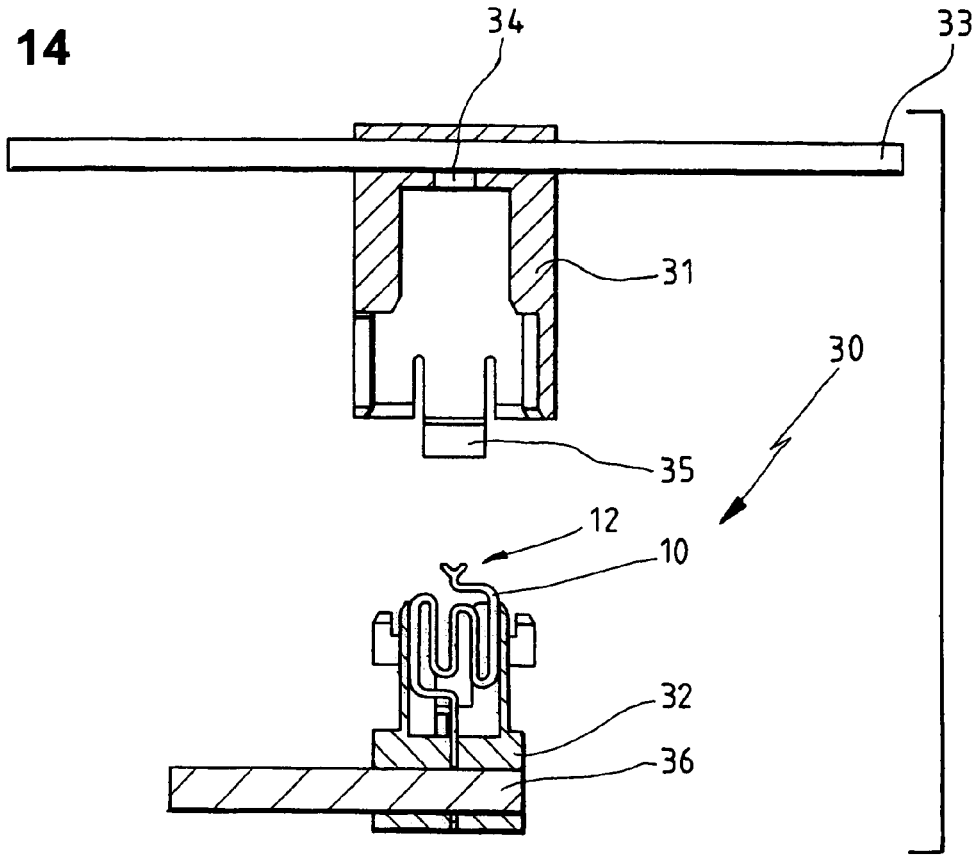
FIG. 14 shows a pressure connector having a pressure contact according to the invention.
Figure 15:
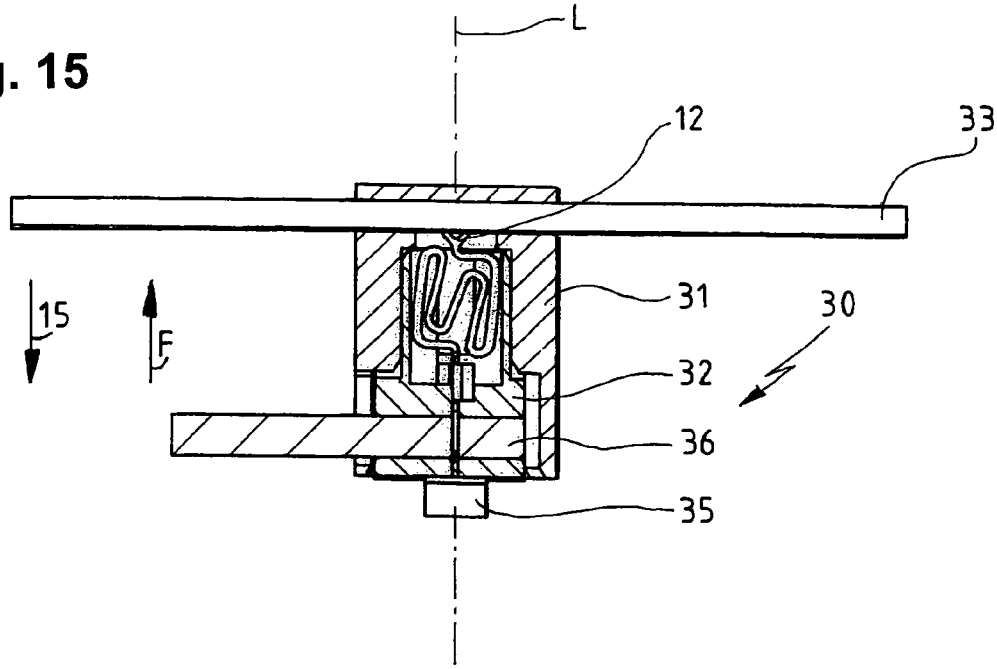
FIG. 15 show the pressure connector according to FIG. 14 in the installed state.

FIGS. 14 and 15 illustrate a plug-in connector 30 comprising two housings 31 and 32. The housing 31 is mounted on a printed circuit board 33 carrying another contact 34. A latch barb for the housing 31 is denoted by reference numeral 35.

A pressure contact 10 according to the FIGS. 5 through 7 is held in the housing 32. A cable 36 is connected to the pressure contact 10 by means at the part 11 (not shown in the drawing) designed as a blade contact.

In FIG. 15, the housing 32 is inserted into the housing 31, and the locking hook 35 engages behind the housing 32 and thus ensures a form-fit, secure connection of the two housings 31 and 32. The part 12 has been displaced along the longitudinal axis L in the direction 15, causing elastic tension to develop in the meander spring 13 (not shown) that exerts the pressure force F on the other contact 34 for the printed circuit board 33. FIGS. 14 and 15 show that the part 12 moves linearly on the longitudinal axis L without being guided by the housings 31 or 32.

In summary, the pressure contact according to the invention thus provides the advantage of a self-guiding linear motion along the longitudinal axis, and at the same time provides high pressure forces and requires little space. The pressure contact is therefore particularly suited for pressure connectors, mobile telephones, for example, which are to have a compact design.

We claim:

1. A pressure contact for making an electrical connection with another contact, the pressure contact comprising:

two end parts spaced apart along a longitudinal axis;

a central spring section having a midpoint lying on the longitudinal axis;

a pair of arcuate side spring sections longitudinally between the end parts, symmetrical to the longitudinal axis, point symmetrical to the midpoint, and each having an outer end connected to a respective one of the end parts and an opposite inner end; and respective loops between and connecting the inner ends of the side spring sections to outer ends of the central spring section, the central and side spring sections forming together with the loops a meander spring substantially point symmetrical to the midpoint, whereby displacement of one of the end parts longitudinally toward the other end part tensions the meander spring, shifts the outer ends of the side spring sections toward each other, shifts the side spring sections away from each other, and pivots the spring sections and loops about the midpoint.

2. The pressure contact defined in claim 1 wherein the central spring section extends at an acute angle across the longitudinal axis.

3. The pressure contact defined in claim 1, further comprising a housing holding the pressure contact with one of the parts projecting from the housing in an unstressed outer position with substantially no elastic deformation of the meander spring and at least partially pushed back into the housing in a stressed inner position with the meander spring tensioned.

4. The pressure contact defined in claim 3 wherein the housing is provided with a support on which the central section is pivoted at the midpoint.

5. The pressure contact defined in claim 1 wherein the central section intersects the longitudinal axis at an angle of less than 60°.

6. The pressure contact defined in claim 1 wherein the central section intersects the longitudinal axis at an angle less than 45°.

7. The pressure contact defined in claim 1 wherein the central section intersects the longitudinal axis at an angle less than 30°.

8. The pressure contact defined in claim 1 wherein the side sections are C-shaped.

9. The pressure contact defined in claim 8 wherein the side sections are concave toward each other.

10. The pressure contact defined in claim 1 wherein one of the parts has two contact feet spaced apart transversely of the axis.

11. The pressure contact defined in claim 10 wherein the feet are symmetrical to the axis.

12. The pressure contact defined in claim 1 wherein the sections and loops are unitarily formed with each other and with the parts.

13. The pressure contact defined in claim 1, further comprising a fixed support at the midpoint supporting the central section for pivotal movement only relative to the midpoint, whereby both of the end parts can be shifted with elastic deformation of the meander spring longitudinally toward the midpoint.

14. The pressure contact defined in claim 1 wherein only one central section is connected via respective loops with two such side sections.

15. The pressure contact defined in claim 1 wherein the side sections extend at an acute angle smaller than 45° to the longitudinal axis.

16. The pressure contact defined in claim 1 further comprising a dielectric housing holding the pressure contact with at least one of the end parts projecting in an outer position from the housing.

17. The pressure contact defined in claim 1 wherein in an unstressed condition of the spring the central spring section lies on the axis.

18. A pressure contact for making an electrical connection with another contact, the pressure contact comprising:

two end parts spaced apart along a longitudinal axis;

a central spring section having a midpoint lying on the longitudinal axis;

a pair of arcuate side spring sections longitudinally between the end parts, symmetrical to the longitudinal axis, point symmetrical to the midpoint, and each having an outer end connected to a respective one of the end parts and an opposite inner end; and respective loops between and connecting the inner ends of the side spring sections to outer ends of the central spring section, the central and side spring sections forming together with the loops a meander spring substantially point symmetrical to the midpoint, whereby displacement of one of the end parts longitudinally toward the other end part tensions the meander spring, shifts the outer ends of the side spring sections toward each other, shifts the side spring sections away from each other, and pivots the spring sections and loops about the midpoint; and a fixed support at the midpoint supporting the central section for pivotal movement only relative to the midpoint, whereby both of the end parts can be shifted with elastic deformation of the meander spring longitudinally toward the midpoint.

* * * * *